United States Patent [19]

Martin

[11] 3,985,236

[45] Oct. 12, 1976

[54] ARTICULATED LINK COUPLER

[75] Inventor: Albert Edward Martin, Lancaster, N.Y.

[73] Assignee: Dresser Industries, Inc., Dallas, Tex.

[22] Filed: May 27, 1975

[21] Appl. No.: 580,638

[52] U.S. Cl. ..... 213/75 R

[51] Int. Cl.[2] ..... B61G 1/28

[58] Field of Search ..... 213/12, 208, 75 R, 75 B; 105/3, 4 R, 4 A; 280/504, 514, 515; 403/157, 158, 154, 151; 24/201 LP; 16/128 A, 162

[56] References Cited

UNITED STATES PATENTS

| | | | |
|---|---|---|---|
| 2,862,314 | 12/1958 | Larsen | 280/515 UX |
| 3,249,239 | 5/1966 | Herbert et al. | 213/75 R X |
| 3,396,673 | 8/1968 | Livelsberger et al. | 213/75 R X |

FOREIGN PATENTS OR APPLICATIONS

| | | | |
|---|---|---|---|
| 1,074,055 | 6/1967 | United Kingdom | 280/515 |

*Primary Examiner*—Robert B. Reeves
*Assistant Examiner*—John P. Shannon
*Attorney, Agent, or Firm*—Raymond T. Majesko; John N. Hazelwood

[57] ABSTRACT

A semi-permanent connection for freight cars having a point of connection and articulation at its center for easily separating the cars and having an alignment control arrangement at the same articulation point so as to provide limited angling as required to meet curve negotiation requirements.

19 Claims, 3 Drawing Figures

ARTICULATED LINK COUPLER

In many unit trains, handling bulk commodities, such as coal, two cars remain connected when passing through unloading stations called rotary dumpers. Since these cars are semi-permanently coupled, a conventional coupler is not necessary and some times a continuous link is used to connect the cars in place of conventional couplers. Since this is a solid member, it is difficult to uncouple the cars when necessary for maintenance.

Accordingly, it is an object of the invention to provide an articulated link coupler that will provide the necessary features of a solid link drawbar but in addition will provide for relatively easy uncoupling when necessary.

Another object of the invention is to provide a pair of couplers which are substantially identical in configuration and can be mated to provide symmetry and form a link by rotating one coupler 180° with respect to the other.

IN THE DRAWINGS

Figure 1:
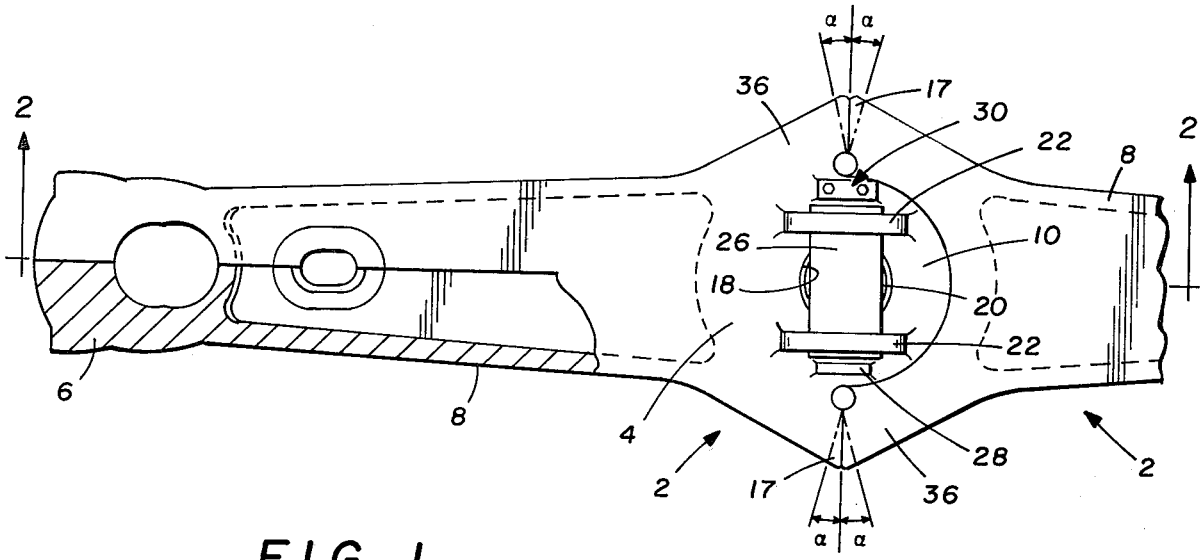
FIG. 1 is a partial plan view in partial cross-section of a pair of linked couplers according to the invention.

In accordance with the present invention, there is provided a coupler capable of being mated with a substantially identical coupler when inverted with respect thereto. The coupler comprises a head, having opposed longitudinal surfaces, and a butt portion connected together by a shank. The head of the coupler contains alternate tenon-like projections and mortise-like depressions to form an offset clevis type connection means.

One of the projections of the coupler head forms one opposed longitudinal surface thereof. The other opposed surface is formed by a depression. Preferably, the coupler head is bifurcated and appears as F-shaped when viewed in side elevation. The projections of the coupler head contain vertically aligned apertures passing therethrough so that when mated with a coupler of substantially identical design but inverted, a pin means may secure the two together.

Referring to the drawings, showing the preferred embodiment, like parts being designated by like reference characters, a pair of couplers 2 are shown. Each coupler contains a head 4, a butt portion 6 and a shank 8 connecting the butt portion to the head. The head of each coupler contains alternate tenon-like projections 10 and 12 and mortise-like depressions 14 and 16. As can be best seen in FIG. 2, the couplers are of substantially identical configuration, one being inverted 180° with respect to the other for mating.

Figure 2:
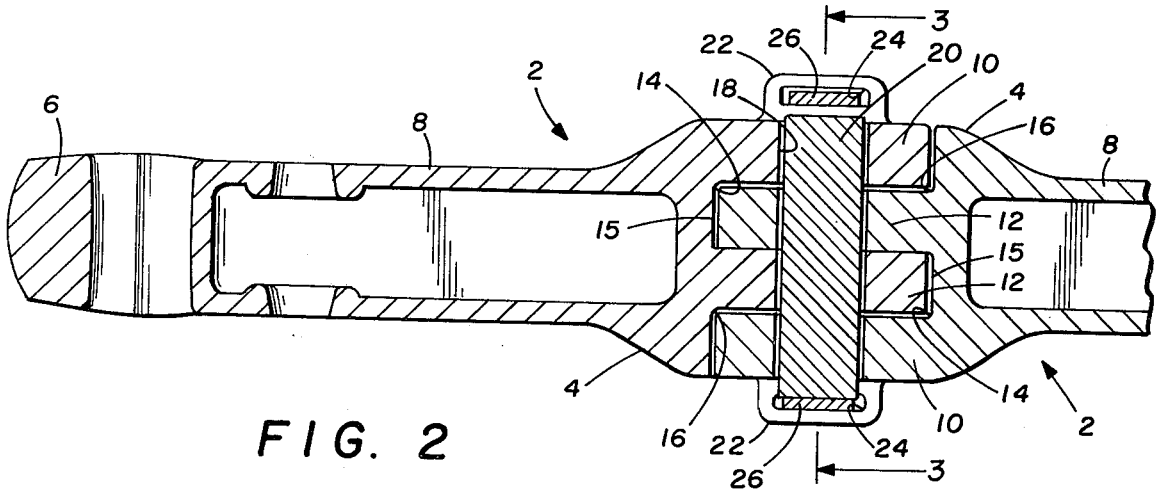
FIG. 2 is an elevation view in partial cross-section taken along the line 2—2 of FIG. 1; and, FIG. 3 is a view in cross-section taken along the line 3—3 of FIG. 2.
Figure 3:
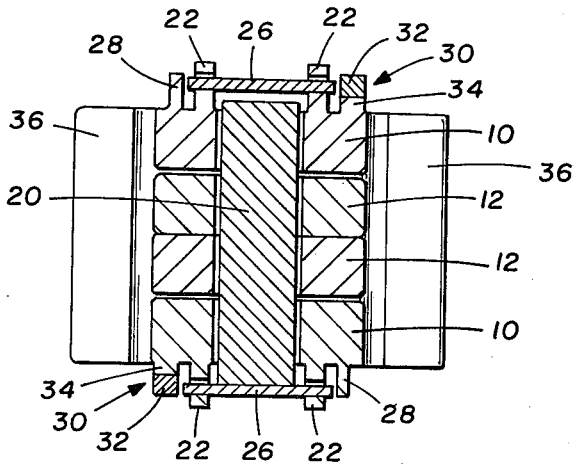

One of the tenon-like projections 10 of each coupler head forms one opposed longitudinal surface. The other longitudinal surface is formed by the depressions 16. This permits the surfaces 15 to carry the buff loads on the couplers. FIG. 2 illustrates the coupler heads 4 to be bifurcated and F-shaped and inverted F-shaped when viewed in side elevation. The coupler head could be trifurcated and the like so long as one longitudinal surface is formed by a projection and the other is formed by a depression. The number of projections and depressions would depend upon the thickness of each required, design considerations and other factors.

The projections 10 and 12 of each coupler head contain vertically aligned apertures 18 passing therethrough for receiving a pin means 20 to secure the mated coupler heads together. The projections 10 of each coupler head preferably contain vertically extending lugs 22 on opposite sides of the aperture 18. The lugs contain key slots 24 for receiving a key means or bar 26 which is disposed above and below the pin means 20 for retention of the pin in limited vertical movement.

To provide for retention and limited horizontal movement of the key means 26, vertically extending stops 28 and 30 may be disposed on exterior sides of the lugs and key slot. One of the stops, for example stop 30, should be a two-piece assembly consisting of an upper segment 32 and a lower segment 34. The upper segment 32 would be joined to the lower segment 34 as by welding, bolting, etc. after the key means 26 is inserted in the key receiving slots 24.

Preferably, the ends of the projections and depressions are arcuate in configuration, as shown in FIG. 1, and the coupler head 4 contains vertical side walls 36 which become juxtaposed when the projections and depressions are mated.

In the arrangement shown, the couplers are articulated at a mid-point between railway cars in such a manner that the articulation angle is limited by the opposed side wall surfaces 17 to a predetermined amount to prevent jack-knifing in compression. The articulation angle shown is essentially 0°, the limit being governed by assembly clearances. It could however be increased an $\alpha$ (angle) consistent with the column strength of the coupler and the loads imposed to provide limited angling for curve negotiation.

It is also preferred that the butt portions 6 of the couplers are symmetrical about the longitudinal axis of the coupler and contoured to provide for vertical angling when connected to a yoke having a non-yielding follower.

Having thus described the invention in detail and with sufficient particularity as to enable those skilled in the art to practice it, what is desired to have protected by Letters Patent is set forth in the following claims.

The embodiments of the invention in which an exclusive property or privilege is claimed are defined as follows:

1. A pair of couplers for connecting railway cars, each coupler comprising a head, having opposed longitudinal surfaces, and a butt portion connected together by a shank, the head of each coupler having alternate tenon-like projections and mortise-like depressions and being of substantially identical configuration, the projections and depressions of said coupler heads being mated together by inverting one of the pair with respect to the other, said coupler heads when mated having a common longitudinal axis.

2. The couplers of claim 1, in which the projections of the coupler heads contain vertically aligned apertures passing therethrough.

3. The couplers of claim 2, in which pin means pass through the projections to secure the mated coupler heads.

4. The couplers of claim 1, in which the coupler heads are bifurcated.

5. The couplers of claim 1, in which one of the projections of the coupler heads form one opposed longitudinal surface thereof and the other opposed surface is formed by a depression.

6. The couplers of claim 2, in which one of said projections of the coupler heads contains vertically extending lugs on opposite sides of the aperture, said lugs having a key slot for receiving a key means.

7. The couplers of claim 6, in which said projections of the coupler heads contain a vertically extending stop exterior to and adjacent said key slots to restrain lateral movement of the key means.

8. The couplers of claim 1, in which the projections and depressions are arcuate.

9. The couplers of claim 1, in which the butt portions are symmetrical about the longitudinal center line of the couplers.

10. The couplers of claim 1, in which vertical side walls are laterally disposed on the heads of each coupler for mating engagement to limit the angling between couplers to a predetermined amount.

11. A coupler capable of being mated with a substantially identical coupler when inverted with respect thereto, said coupler comprising a head, having opposed longitudinal surfaces, and a butt portion connected together by a shank, the head of the coupler having alternate tenon-like projections and mortise-like depressions, one of the projections of the coupler head forming one opposed, outer longitudinal surface thereof, the other opposed, outer longitudinal surface being formed by a depression.

12. The coupler of claim 11, in which the projections of the coupler head contains vertically aligned apertures passing therethrough.

13. The coupler of claim 11, in which the coupler head is bifurcated.

14. The coupler of claim 12, in which one of the projections of the coupler head contains vertically extending lugs on opposite sides of the aperture, said lugs having a key slot for receiving a key means.

15. The coupler of claim 14, in which said projection of the coupler head contains a vertically extending stop exterior and adjacent said key slots to restrain lateral movement of the key means.

16. The coupler of claim 11, in which the projections and depressions are arcuate.

17. The coupler of claim 11, in which the coupler head is F-shaped in side elevation.

18. The coupler of claim 11, in which the butt portion is symmetrical about the longitudinal center line of the coupler.

19. The coupler of claim 11, in which vertical side walls are laterally disposed on the head so that when mated with a substantially identical coupler, angling between couplers is limited to a predetermined amount.

* * * * *